US011371508B2

(12) United States Patent
Cao et al.

(10) Patent No.: US 11,371,508 B2
(45) Date of Patent: Jun. 28, 2022

(54) EXHAUST ASSEMBLY AND COMPRESSOR

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Cong Cao, Zhuhai (CN); Tianyi Zhang, Zhuhai (CN); Yushi Bi, Zhuhai (CN)

(73) Assignees: GREE ELECTRIC APPLIANCES (WUHAN) CO., LTD, Wuhan (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 54 days.

(21) Appl. No.: 16/642,901

(22) PCT Filed: Aug. 30, 2018

(86) PCT No.: PCT/CN2018/103230
§ 371 (c)(1),
(2) Date: Feb. 28, 2020

(87) PCT Pub. No.: WO2019/047764
PCT Pub. Date: Mar. 14, 2019

(65) Prior Publication Data

US 2021/0062812 A1 Mar. 4, 2021

(30) Foreign Application Priority Data

Sep. 7, 2017 (CN) ..... 201710800872.X

(51) Int. Cl.
*F04C 29/02* (2006.01)
*F04C 29/12* (2006.01)

(52) U.S. Cl.
CPC ..... *F04C 29/12* (2013.01); *F04C 29/02* (2013.01)

(58) Field of Classification Search
CPC ..... F04C 29/02; F04C 29/06; F04C 29/12; F04C 29/026; F04C 29/0092; F04C 18/16
See application file for complete search history.

(56) References Cited

U.S. PATENT DOCUMENTS 6,520,758 B1 * 2/2003 Sowards ..... F04C 29/0021 418/1
6,769,890 B2 * 8/2004 Vigano' ..... F04C 18/086 418/178

(Continued)

FOREIGN PATENT DOCUMENTS

CN 204113661 U 1/2015
CN 205277820 U 6/2016

(Continued)

OTHER PUBLICATIONS

Machine Translation WO 2018-126752 (Year: 2021).*

(Continued)

*Primary Examiner* — Audrey B. Walter
*Assistant Examiner* — Dapinder Singh
(74) *Attorney, Agent, or Firm* — Kilpatrick Townsend & Stockton, LLP

(57) ABSTRACT

An exhaust assembly and a compressor including the exhaust assembly. The exhaust assembly includes an exhaust bearing seat; an intake cavity is provided at an intake end of the exhaust bearing seat; an exhaust cavity is provided at an exhaust end of the exhaust bearing seat; the intake cavity and the exhaust cavity are staggered with each other in the axial direction of the exhaust bearing seat; the exhaust bearing seat is provided with a flow passage for connecting the intake cavity with the exhaust cavity; and an oil separation structure is provided in the exhaust cavity.

16 Claims, 6 Drawing Sheets

(56) References Cited

U.S. PATENT DOCUMENTS

| | | | | |
|---|---|---|---|---|
| 7,052,259 | B2 * | 5/2006 | Nachi | F04C 29/12 418/206.4 |
| 8,096,288 | B2 * | 1/2012 | Ouwenga | F04C 18/12 123/559.1 |
| 9,415,335 | B2 * | 8/2016 | Huff | F25B 43/00 |

FOREIGN PATENT DOCUMENTS

| | | | | |
|---|---|---|---|---|
| CN | 106678046 | A | 5/2017 | |
| CN | 106989027 | A | 7/2017 | |
| CN | 107355386 | A | 11/2017 | |
| CN | 207297379 | U | 5/2018 | |
| EP | 2828523 31 | | 1/2015 | |
| JP | S5434111 | A | 3/1979 | |
| JP | S5654987 | A | 5/1981 | |
| JP | H08109887 | A | 4/1996 | |
| JP | 2001065483 | A | 3/2001 | |
| JP | 2002070778 | A | 3/2002 | |
| WO | WO-2018126752 | A1 * | 7/2018 | F04C 29/026 |

OTHER PUBLICATIONS

Machine Translation JP S56 54987 (Year: 2021).*
India Patent Office, examination report issued in Application No. 202037010300, dated Jan. 18, 2021, total 5 pages.

* cited by examiner

EXHAUST ASSEMBLY AND COMPRESSOR

CROSS-REFERENCES TO RELATED APPLICATIONS

This application is a U.S. National Stage of International Application No. PCT/CN2018/103230, filed on Aug. 30, 2018, which claims the benefit of the priority to Chinese Patent Application No. 201710800872. X, entitled "Exhaust Assembly and Compressor", filed on Sep. 7, 2017, the content of each of which is expressly incorporated herein by reference in its entirety.

FIELD

The present disclosure relates to the field of compressor technology, and particularly to an exhaust assembly and a compressor.

BACKGROUND

In a single-machine two-stage screw compressor, a first-stage exhaust gas enters a second-stage compression chamber after cooling a motor. In order to reduce the temperature and lubricate the bearing, it is necessary to inject a refrigerant oil into a bearing cavity, and the refrigerant oil in the bearing cavity will eventually return to a second-stage rotor cavity and flow out with the exhaust gas. For a conventional single-stage screw compressor, there is only a single-stage rotor, and the amount of the refrigerant oil returned to the rotor cavity is not large. Therefore, most of the refrigerant oil can be filtered out through a built-in oil separation structure, which has little impact on the energy efficiency.

For the single-machine two-stage screw compressor, during a second-stage compression, there is not only the return-oil carried in the first-stage exhaust gas, but also the return-oil from the bearing cavity. Due to the excessive amount of refrigerant oil entering the second-stage rotor cavity, the amount of effective compressed refrigerant is reduced, which may affect the energy efficiency.

In order to the improve energy efficiency, it is necessary to provide an oil separation structure after the first-stage exhausting inside the single-machine two-stage screw compressor to reduce the amount of the oil entering the secondary rotor cavity. However, in the existing single-machine two-stage screw compressor, the first-stage exhaust gas mainly passes through a bottom portion of a bearing seat, and the bottom portion of the bearing seat is provided with a slide valve support structure, thus, the available space is limited and the oil separation structure cannot be arranged.

SUMMARY

The objective of the present disclosure is to provide an exhaust assembly and a compressor, which can solve the problem of excessive oil content in the exhaust gas and the problem that the oil separation structure occupying a large space cannot be installed due to a space limitation.

In order to achieve the above objective, the present disclosure provides an exhaust assembly including an exhaust bearing seat, an intake end of the exhaust bearing seat is provided with an intake cavity, an exhaust end of the exhaust bearing seat is provided with an exhaust cavity, the intake cavity and the exhaust cavity are staggered from each other along an axial direction of the exhaust bearing seat, the exhaust bearing seat is provided with a flow channel connecting the intake cavity with the exhaust cavity, and an oil separation structure is provided in the exhaust cavity.

In an alternative embodiment, the flow channel is arc shaped, to make a gas flow passing through the flow channel have a component rotationally flowing around an axis of the exhaust bearing seat.

In an alternative embodiment, an outer contour of the exhaust cavity is arc shaped, and the flow channel is tangent to the exhaust cavity.

In an alternative embodiment, an outer contour of the intake cavity is arc shaped, and the flow channel is tangent to the intake cavity.

In an alternative embodiment, the oil separation structure includes at least two perforated plates, and a filter screen is provided between adjacent perforated plates.

In an alternative embodiment, an outer contour of the oil separation structure matches a shape of the exhaust cavity.

In an alternative embodiment, an oil drain slot is provided at a bottom portion of the exhaust cavity and communicates with a first oil drain port provided at a bottom portion of the exhaust bearing seat.

In an alternative embodiment, the bottom portion of the exhaust cavity is laterally provided with a second oil drain port.

In order to achieve the above purpose, the present disclosure further provides a compressor including the exhaust assembly in any one of the above-mentioned embodiments.

In an alternative embodiment, the compressor includes a multi-stage compressor.

In an alternative embodiment, the exhaust assembly is provided between a low-pressure-stage exhaust end and a high-pressure-stage intake end of the multi-stage compressor.

Based on the above-mentioned technical solutions, the present disclosure at least has the following advantages.

In an embodiment of the present disclosure, the intake cavity and the exhaust cavity are staggered from each other along the axial direction of the exhaust bearing seat, an exhaust gas of the intake cavity is guided into the exhaust cavity through a provided flow channel, and an oil separation structure is provided in the exhaust cavity, thereby fully utilizing the space at the exhaust end of the exhaust bearing seat to mount the oil separation structure, and accordingly solving the problem that the oil separation structure occupying large space cannot be mounted due to the space limitation; in addition, by providing the oil separation structure, the oil content of the exhaust gas can be significantly reduced, the amount of the effective compressed refrigerant can be increased, and the energy efficiency can be significantly improved.

BRIEF DESCRIPTION OF THE DRAWINGS

The drawings described herein are used for providing a further understanding of the present disclosure and constituting a part of the present disclosure. The exemplary embodiments of the present disclosure and the descriptions thereof are used for explaining the present disclosure and do not constitute any improper limitation on the present disclosure. In the drawings.

Figure 1:
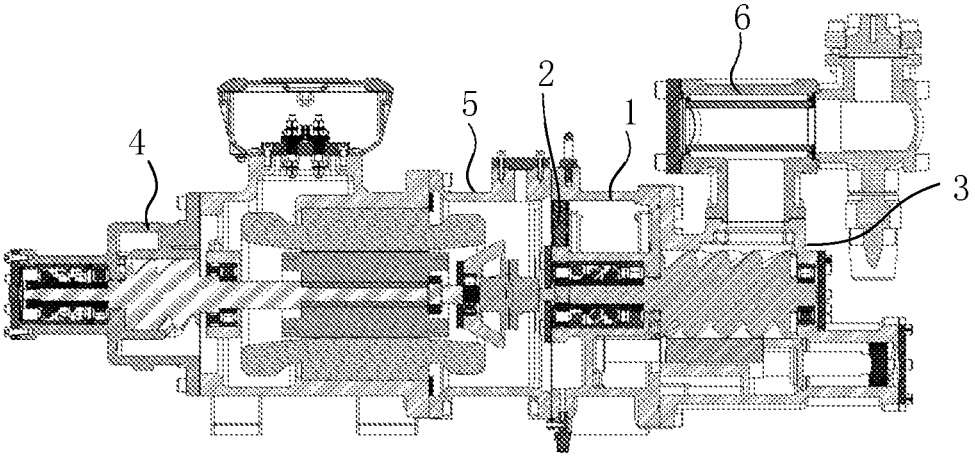
FIG. 1 is a schematic front view illustrating a built-in exhaust assembly of a compressor according to an embodiment of the present disclosure.

The reference signs in the drawings are provided as follows:

1, exhaust bearing seat; 11, intake cavity; 12, exhaust cavity; 13, flow channel; 14, oil drain slot; 15, first oil drain port; 16, second oil drain port;

2, oil separation structure; 21, perforated plate;

3, low-pressure-stage component;

4, high-pressure-stage component;

5, medium-pressure-stage component;

6, filter.

DETAILED DESCRIPTION OF THE INVENTION

The technical solutions in the embodiments will be clearly and completely described below with reference to the accompanying drawings. Apparently, the embodiments described hereinafter are only a part the embodiments of the present disclosure, but not all the embodiments. Based on the embodiments of the present disclosure, all other embodiments obtained by persons skilled in the art without creative efforts shall fall within the scope of protection of the present disclosure.

In the description of the present disclosure, it should be understood that the orientations or positional relationships indicated by the terms, such as "center", "longitudinal", "lateral", "front", "rear", "left", "right", "vertical", "horizontal", "top", "bottom", "inside", "outside", etc., are the orientations or positional relationships shown based on the drawings, and are only intended to facilitate and simplify the description of the present disclosure, rather than intended to indicate or imply that the device or element involved definitely have a particular orientation or are constructed and operated in a particular orientation, thus, they cannot be understood as a limitation on the scope of protection of the present disclosure.

Figure 2:
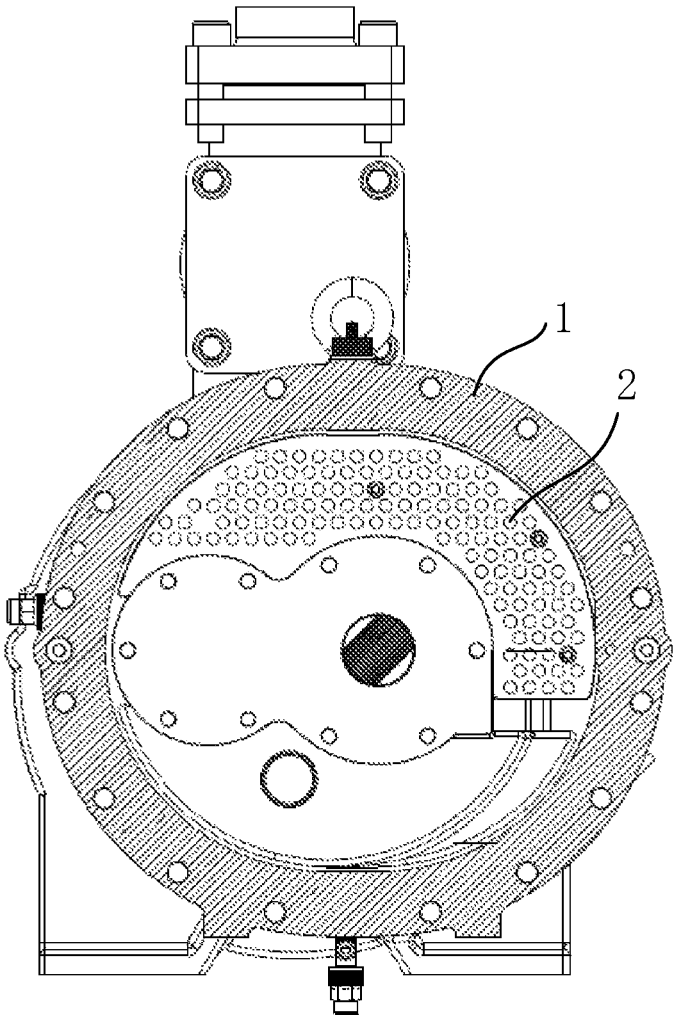
FIG. 2 is a schematic side view illustrating the built-in exhaust assembly of the compressor according to an embodiment of the present disclosure.

As shown in FIGS. 1 and 2, the schematic views illustrating a compressor, provided by an embodiment of the present disclosure, provided with an exhaust assembly provided by the embodiment of the present disclosure are shown. The exhaust assembly provided by an embodiment of the present disclosure includes an exhaust bearing seat 1 and an oil separation structure 2.

Figure 4:
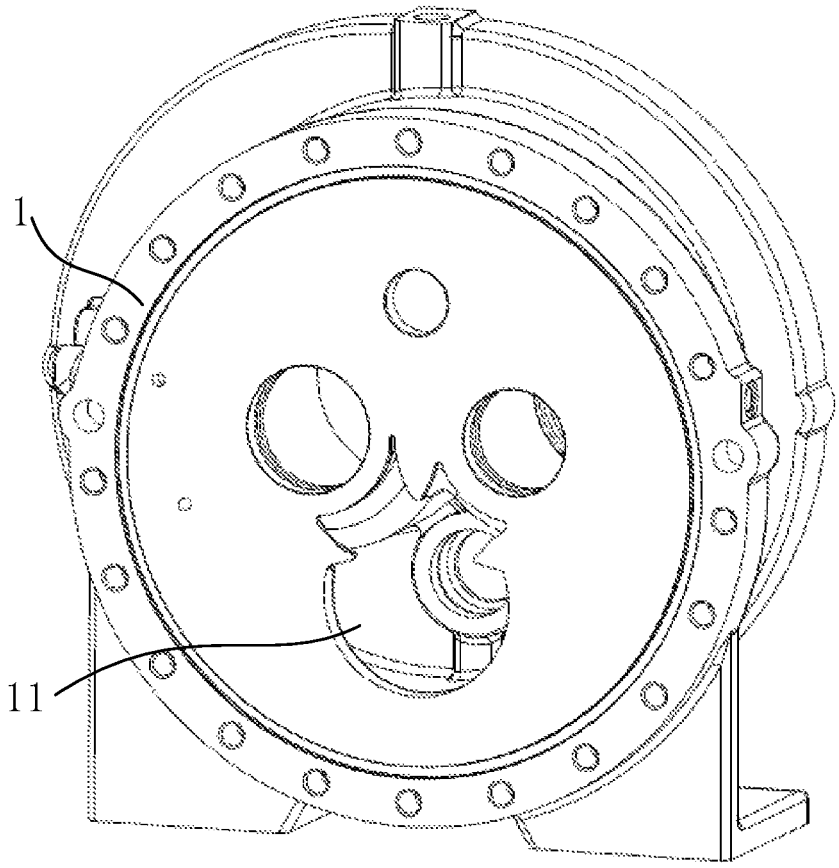
FIG. 4 is a schematic view illustrating an intake end of an exhaust bearing seat according to an embodiment of the present disclosure.
Figure 5:
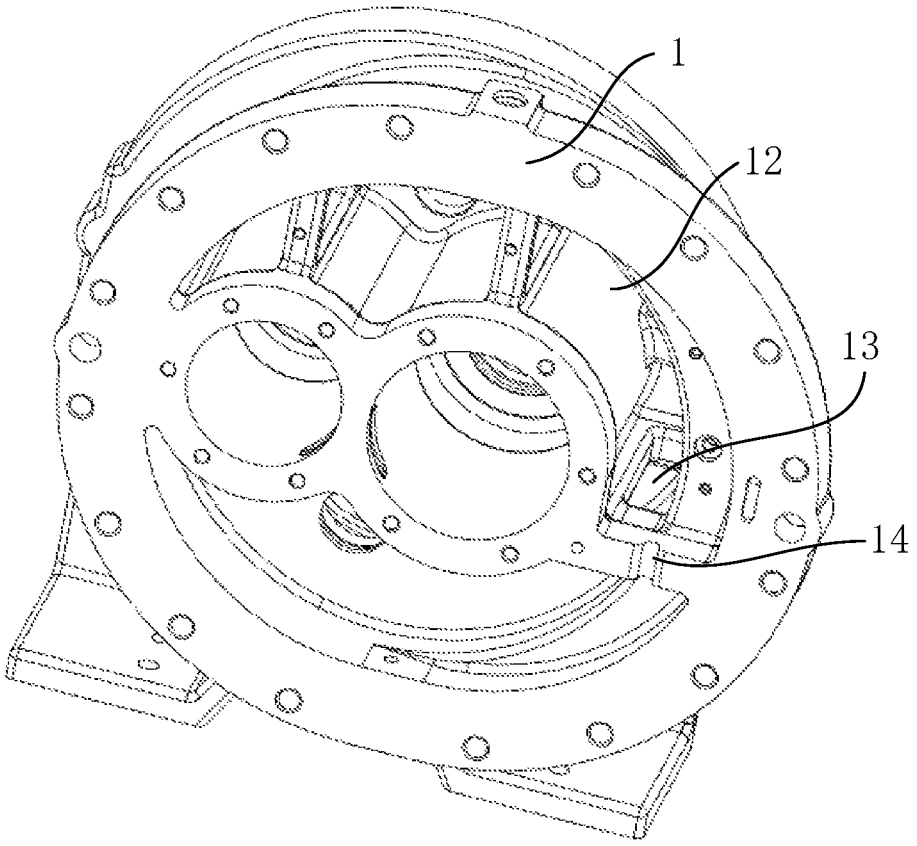
FIG. 5 is a schematic view illustrating an exhaust cavity and a flow channel of the exhaust bearing seat according to an embodiment of the present disclosure.

As shown in FIG. 4, an intake end of an exhaust bearing seat 1 is provided with an intake cavity 11. As shown in FIG. 5, an exhaust end of the exhaust bearing seat 1 is provided with an exhaust cavity 12. The intake cavity 11 and the exhaust cavity 12 are staggered from each other along an axial direction of the exhaust bearing seat 1. The exhaust bearing seat 1 is provided with a flow channel 13 connecting the intake cavity 11 with the exhaust cavity 12. As shown in FIG. 2, an oil separation structure 2 is provided in the exhaust cavity 12. The oil separation structure 2 is configured to separate the oil and gas, to reduce the oil content of the exhaust gas and improve the compression energy efficiency of the compressor.

The exhaust assembly provided in an embodiment of the present disclosure can be applied to the compressor, for example, a multi-stage compressor. The multi-stage compressor includes a two-stage compressor and a three or more-stage compressor. The two-stage compressor includes a single-machine two-stage screw compressor.

As shown in FIG. 1, the compressor in an embodiment of the present disclosure is the multi-stage compressor with at least two stages. The multi-stage compressor has a low-pressure-stage component 3 and a high-pressure-stage component 4. A gas stream compressed by the low-pressure-stage component 3 enters the high-pressure-stage component 4. The exhaust bearing seat 1 is provided between an exhaust end of the low-pressure-stage component 3 and an intake end of the high-pressure-stage component 4. The oil separation structure 2 is provided in the exhaust cavity 12 for separating the oil from the gas, which can reduce the oil content of the exhaust gas of the low-pressure-stage component 3 and improve the compression energy efficiency of the high-pressure-stage component 4.

After being respectively assembled, the low-pressure-stage component 3 and the high-pressure-stage component 4 can be connected to and assembled on the medium-pressure-stage component 5 by couplings.

In an embodiment of the present disclosure, the compressor is the multi-stage compressor with at least two stages, and the low-pressure-stage component 3 and the high-pressure-stage component 4 of the compressor may be any two adjacent pressure-stage components. The low-pressure-stage component 3 generally includes a female rotor, a male rotor, and a slide valve. The slide valve may be a lower type or an upper type.

In the case where the slide valve is disposed in a lower position, that is, the slide valve is disposed below the female rotor and the male rotor, the exhaust gas in the low-pressure-stage component 3 mainly passes through the lower portion of the exhaust bearing seat 1. Since it is required to dispose a slide valve support structure at the lower portion of the exhaust end of the exhaust bearing seat 1, the available space at the lower portion of the exhaust bearing seat 1 is limited, accordingly, the intake cavity 11 may be disposed at the lower portion of the intake end of the exhaust bearing seat 1 (as shown in FIG. 4), and the exhaust cavity 12 may be disposed on the upper portion of the exhaust end of the exhaust bearing seat 1 (as shown in FIG. 5), so that the intake cavity 11 and the exhaust cavity 12 are staggered from each other along the axial direction of the exhaust bearing seat 1 (that is, the axial direction of the compressor), to make full use of the space at the exhaust end of the exhaust bearing seat 1 to install the oil separation structure 2.

In the case where the slide valve is disposed in an upper position, that is, the slide valve is disposed above the female rotor and the male rotor, the exhaust gas in the low-pressure-stage component 3 mainly passes through the upper portion of the exhaust bearing seat 1. Since it is required to dispose a slide valve support structure at the upper portion of the exhaust end of the exhaust bearing seat 1, so that the available space at the upper portion of the exhaust bearing seat 1 is limited, accordingly, the intake cavity 11 may be disposed at the upper portion of the intake end of the exhaust bearing seat 1, and the exhaust cavity 12 may be disposed at the lower portion of the exhaust end of the exhaust bearing seat 1, so that the intake cavity 11 and the exhaust cavity 12 are staggered from each other along the axial direction of the exhaust bearing seat 1 (that is, the axial direction of the compressor), to make full use of the space at the exhaust end of the exhaust bearing seat 1 to install the oil separation structure 2.

In an embodiment of the present disclosure, the intake cavity 11 and the exhaust cavity 12 are staggered from each other along the axial direction of the compressor, and a flow channel 13 is provided to connect the intake cavity 11 with the exhaust cavity 12, so that the space at the exhaust end of the exhaust bearing seat 1 can be effectively utilized to install the oil separation structure 2, thereby solving the problem that the oil separation structure occupying large space cannot be installed due to the space limitation.

Furthermore, in an embodiment of the present disclosure, the oil separation structure 2 is provided downstream with respect to the exhaust end of the low-pressure-stage component 3 and upstream with respect to the intake end of the high-pressure-stage component 4 (the exhaust cavity 12 of the exhaust bearing seat 1), to make the oil content of the exhaust gas of the low-pressure-stage component 3 significantly reduced, that is, the oil content of the exhaust gas entering the high-pressure-stage component 4 can be significantly reduced, thereby increasing the amount of the effective compressed refrigerant and improving the energy efficiency significantly.

In the exhaust assembly according to an embodiment of the present disclosure, the flow channel 13 can be arranged in an arc shape, so that the gas flow passing through the flow channel 13 has a portion rotationally flowing around the axis of the exhaust bearing seat 1 (that is, the axis of the compressor), and the gas flow is separated into oil and gas under the centrifugal force and the impact action, thereby improving the efficiency of the oil-gas separation.

In an alternative embodiment, the outer contour of the exhaust cavity 12 may be arc shaped, the flow channel 13 may be tangent to the exhaust cavity 12, and the exhaust gas flow in the flow channel 1 can enter the exhaust cavity 12 along the tangential direction of the exhaust cavity 12, so that the gas flow can flow along the inner wall of the exhaust cavity 12 to the maximum extent, thereby improving the power of the rotational flow, generating a centrifugal effect on the gas flow, and improving the oil separation efficiency from various aspects such as centrifugal effect, uniform flow field, impact separation, etc.

In an alternative embodiment, the outer contour of the intake cavity 11 may also be arc shaped, and the flow channel 13 may also be tangent to the intake cavity 11, so that the gas flow in the intake cavity 11 flows out along the tangential direction of the intake cavity 11, to provide a power for rotational flow in the intake cavity 11.

In the exhaust assembly according to an embodiment of the present disclosure, the oil separation structure 2 may include at least two perforated plates 21, and a filter screen may be provided between two adjacent perforated plates 21.

In an alternative embodiment, the oil separation structure 2 may include two perforated plates 21 and one filter screen. One perforated plate 21 is fixed on the upper portion of the exhaust bearing seat 1, and then a filter screen is mounted, and pressed by the other perforated plate 21, and which may be fixed on the exhaust bearing seat 1 with a screw. The filter screen can be fixed within the perforated plates 21 through two layers of perforated plates 21, to prevent the filter screen from falling off and into the compression cavity.

For the exhaust assembly according to an embodiment of the present disclosure, since the exhaust cavity 12 is located at the exhaust end of the exhaust bearing seat 1 and staggered with the intake cavity 11 of the exhaust bearing seat 1 in the axial direction of the exhaust bearing seat 1 (the axial direction of the compressor), and the available space is of irregular shape, accordingly, the outer contour of the oil separation structure 2 matches the shape of the exhaust cavity 12 and also has an irregular shape.

Figure 3:
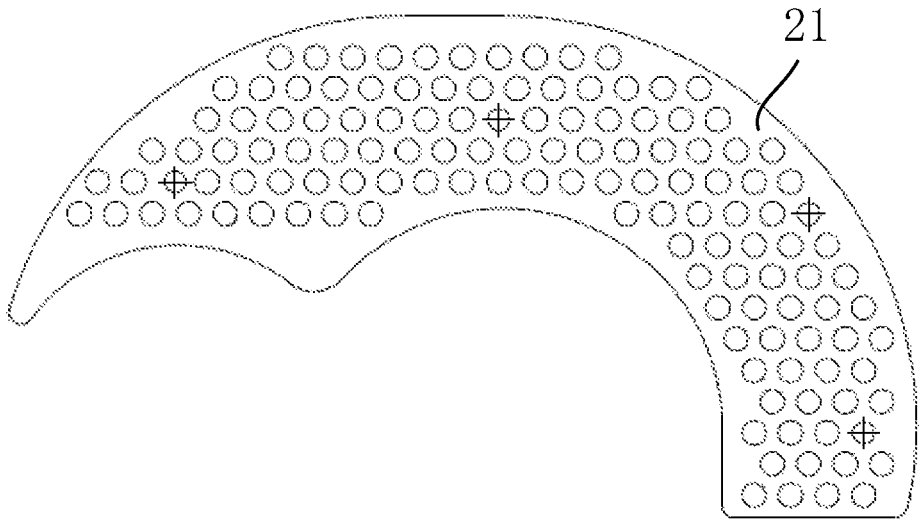
FIG. 3 is a schematic view illustrating a perforated plate of an oil separation structure according to an embodiment of the present disclosure.

As shown in FIG. 3, the perforated plate 21 has an irregular shape and matches the shape of the exhaust cavity 12. The perforated plate 21 is uniformly provided with holes, and the aperture of each hole can be adjusted according to the actual flow. For example, the aperture may range from φ10 mm to φ15 mm.

The oil separation structure 2 can be fixed on the exhaust bearing seat 1 through four screws. In the actual application, the fixation can be adjusted and strengthened based on the structure and internal pressure, to prevent the oil component structure 2 from falling off under the impact of the gas flow.

Depending on the internal pressure, the above screws can be selected as M8 or M6.

In the actual application, the shape of the oil separation structure 2 according to an embodiment of the present disclosure can be adjusted based on the specific structure of the exhaust cavity 12; the thickness of the oil separation structure 2 may also be adjusted based on the space; and the aperture of each hole in the perforated plate 21 may be adjusted based on the flow of the compressor. Thus, when the flow is large, a larger aperture can be selected to reduce the pressure loss.

Figure 6:
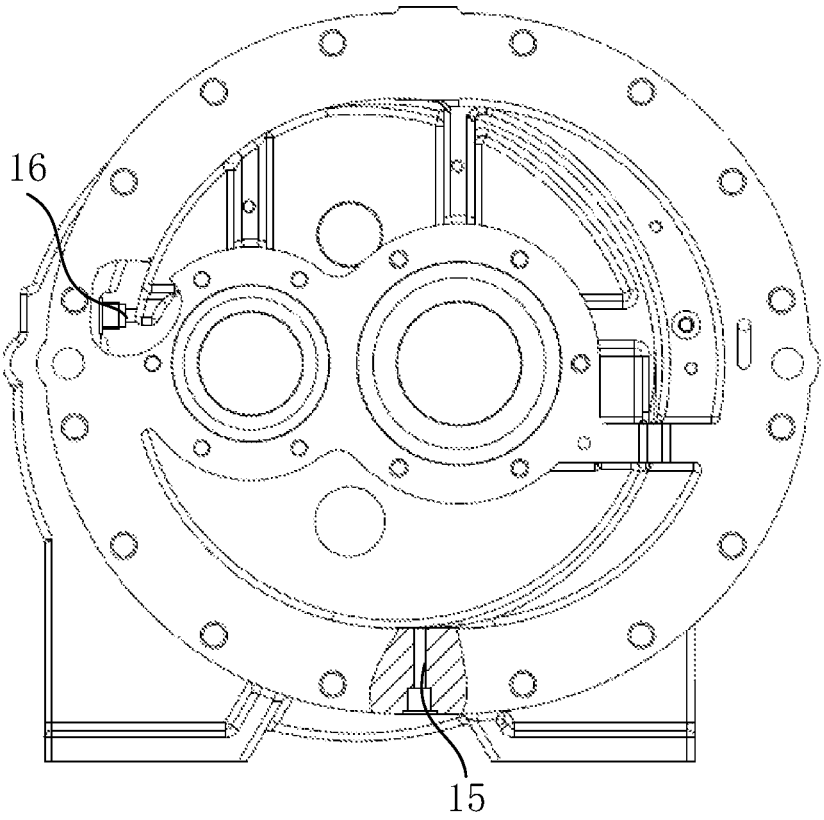
FIG. 6 is a schematic view illustrating an oil drain port of the exhaust bearing seat according to an embodiment of the present disclosure.

The exhaust gas is separated into oil and gas after passing through the oil separation structure 2, and the refrigerant oil remains inside the exhaust bearing seat 1. Thus, an oil drain slot 14 (as shown in FIG. 5) may be disposed on the bottom portion of the exhaust cavity 12 (the middle portion of the exhaust bearing seat 1), a first oil drain port 15 can be disposed on the bottom portion of the exhaust bearing seat 1 (as shown in FIG. 6), and the oil drain slot 14 communicates with the first oil drain port 15. An oil drain valve may also be disposed at the first oil drain port 15. The oil accumulated at the bottom portion of the exhaust cavity 12 can enter the bottom portion of the exhaust bearing seat 1 through the oil drain slot 14, and then the refrigerant oil may be drawn forth through the oil drain valve at the first oil drain port 15.

In the above embodiment, due to the influence of the structure of the exhaust bearing seat 1, a part of the refrigerant oil cannot flow out directly from the oil drain slot 14 in the middle portion of the exhaust bearing seat 1 after separation, but is accumulated in a groove on the side, thus, a second oil drain port 16 may also be provided laterally at the bottom portion of the exhaust chamber 12 (as shown in FIG. 6).

Based on the descriptions of the above-mentioned embodiments, a two-stage compressor with a lower-type slide valve is taken as an example to detail the gas flow direction in the exhaust assembly according to an embodiment of the present disclosure.

Since the oil cylinder is externally mounted, the entire internal space of the exhaust bearing seat 1 is configured to exhaust the gas. The lower portion of the exhaust end of the exhaust bearing seat 1 is provided with the slide valve support structure, and the space at the lower portion of the exhaust bearing seat 1 is closed. The exhaust gas of the low-pressure-stage component 3 enters from the intake cavity 11 of the lower portion of the exhaust bearing seat 1 shown in FIG. 4, and after impacting an opposite baffle, the exhaust gas flows upward along the arc surface of a housing, and is discharged tangentially into the exhaust cavity 12 of the upper portion of the exhaust bearing seat 1 from the flow channel 13 shown in FIG. 5, and flows rotationally within the exhaust cavity 12. The effect of oil-gas separation can be improved through the impacting and the centrifugal force.

The oil separation structure 2 is provided in the exhaust cavity 12, and the oil-gas mixture passes through the oil separation structure 2 to undergo the oil-gas separation. A part of the separated refrigerant oil flows out along the top portion of the exhaust cavity 12, and the second oil drain port 16 is provided on the side wall of the exhaust bearing seat 1 to recycle the refrigerant oil. Another part of the separated refrigerant oil flows out through the oil drain slot 14 disposed along the transverse rib at the middle portion of the exhaust bearing seat 1 inside the filter screen. The separated refrigerant oil flows downward, and accumulates at the bottom portion of the exhaust bearing seat 1, then flows out through the first oil drain port 15 provided at the bottom portion of the exhaust bearing seat 1, and then can be recycled into the system. A small amount of refrigerant oil flowing back into the flow channel 13 may reenter the oil separation structure 2 for separation under the impact of the gas flow.

The present disclosure also provides an exemplary embodiment of a compressor. In the present exemplary embodiment, the compressor includes the exhaust assembly in any one of the above-mentioned embodiments.

The compressor according to an embodiment of the present disclosure may be a multi-stage compressor, such as a two-stage compressor, or a three or more-stage compressor. The two-stage compressor may be a single machine two-stage screw compressor.

The multi-stage compressor according to an embodiment of the present disclosure includes a low-pressure-stage component 3 and a high-pressure-stage component 4. The exhaust assembly may be provided between an exhaust end of the low-pressure-stage component 3 of the multi-stage compressor and an intake end of the high-pressure-stage component 4 of the multi-stage compressor.

As shown in FIG. 1, in an alternative embodiment, the compressor may further include a filter 6 that may be mounted outside an intake port of the low-pressure-stage component 3. In this way, the external space can be effectively utilized and the effect of the intake and the filtration can be improved.

It should be noted that, in the description of the present disclosure, terms such as "first", "second", etc., used for limiting parts are merely intended to facilitate the distinction of the above-mentioned parts. Unless otherwise stated, the above terms have no special meaning, and cannot be understood as limiting the scope of protection of the present disclosure.

Finally, it should be noted that the above-mentioned embodiments are merely used for illustrating the technical solution of the present disclosure and are not intended to limit it. Although the present disclosure is detailed with reference to the embodiments, those skilled in the art should understand that modifications to the embodiments of the present disclosure or equivalent replacements of partial technical features of the present disclosure can be made without departing from the spirit of the technical solution of the present disclosure, and all of the modifications and the equivalent replacements should be included in the scope of the technical solution claimed in the present disclosure.

The invention claimed is:

1. An exhaust assembly, comprising an exhaust bearing seat, wherein an intake end of the exhaust bearing seat is provided with an intake cavity, an exhaust end of the exhaust bearing seat is provided with an exhaust cavity, the intake cavity and the exhaust cavity are staggered from each other along an axial direction of the exhaust bearing seat, the exhaust bearing seat is provided with a flow channel connecting the intake cavity with the exhaust cavity, and an oil separation structure is provided in the exhaust cavity;

wherein, the flow channel is arc shaped, to make a gas flow passing through the flow channel have a component rotationally flowing around an axis of the exhaust bearing seat.

2. The exhaust assembly according to claim 1, wherein, an outer contour of the exhaust cavity is arc shaped, and the flow channel is tangent to the exhaust cavity.

3. The exhaust assembly according to claim 1, wherein, an outer contour of the intake cavity is arc shaped, and the flow channel is tangent to the intake cavity.

4. The exhaust assembly according to claim 1, wherein, the oil separation structure comprises at least two perforated plates, and a filter screen is provided between adjacent perforated plates.

5. The exhaust assembly according to claim 1, wherein, an outer contour of the oil separation structure matches a shape of the exhaust cavity.

6. The exhaust assembly according to claim 1, wherein, an oil drain slot is provided at a bottom portion of the exhaust cavity and communicates with a first oil drain port provided at a bottom portion of the exhaust bearing seat.

7. The exhaust assembly according to claim 1, wherein, a bottom portion of the exhaust cavity is laterally provided with a second oil drain port.

8. A compressor, comprising the exhaust assembly of claim 1.

9. The compressor according to claim 8, wherein, the compressor comprises a multi-stage compressor.

10. The compressor according to claim 9, wherein, the exhaust assembly is provided between a low-pressure-stage exhaust end and a high-pressure-stage intake end of the multi-stage compressor.

11. The compressor according to claim 8, wherein, an outer contour of the exhaust cavity is arc shaped, and the flow channel is tangent to the exhaust cavity.

12. The compressor according to claim 8, wherein, an outer contour of the intake cavity is arc shaped, and the flow channel is tangent to the intake cavity.

13. The compressor according to claim 8, wherein, the oil separation structure comprises at least two perforated plates, and a filter screen is provided between adjacent perforated plates.

14. The compressor according to claim 8, wherein, an outer contour of the oil separation structure matches a shape of the exhaust cavity.

15. The compressor according to claim 8, wherein, an oil drain slot is provided at a bottom portion of the exhaust cavity and communicates with a first oil drain port provided at a bottom portion of the exhaust bearing seat.

16. The compressor according to claim 8, wherein, a bottom portion of the exhaust cavity is laterally provided with a second oil drain port.

* * * * *